US011228107B2

(12) United States Patent
Lee et al.

(10) Patent No.: US 11,228,107 B2
(45) Date of Patent: Jan. 18, 2022

(54) ANTENNA SUBSTRATE

(71) Applicant: SAMSUNG ELECTRO-MECHANICS CO., LTD., Suwon-si (KR)

(72) Inventors: Yang Je Lee, Suwon-si (KR); Chang Gun Oh, Suwon-si (KR); Hyun Kyung Park, Suwon-si (KR); Jung Hoon Jang, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 24 days.

(21) Appl. No.: 16/938,023

(22) Filed: Jul. 24, 2020

(65) Prior Publication Data

US 2021/0376473 A1 Dec. 2, 2021

(51) Int. Cl.

| | |
|---|---|
| ***H01Q 9/04*** | (2006.01) |
| ***H01Q 21/06*** | (2006.01) |
| ***H01Q 1/22*** | (2006.01) |

(52) U.S. Cl.

CPC ..... *H01Q 9/0414* (2013.01); *H01Q 1/22* (2013.01); *H01Q 21/065* (2013.01)

(58) Field of Classification Search

CPC ..... H01Q 9/04; H01Q 9/0414; H01Q 21/06; H01Q 21/065; H01Q 1/36; H01Q 1/38

See application file for complete search history.

(56) References Cited

U.S. PATENT DOCUMENTS

| | | | | |
|---|---|---|---|---|
| 10,965,030 | B2 * | 3/2021 | Han | H01Q 1/526 |
| 2011/0248891 | A1 * | 10/2011 | Han | H01Q 13/106 343/700 MS |
| 2016/0043470 | A1 * | 2/2016 | Ko | H01Q 9/045 343/843 |
| 2016/0211586 | A1 * | 7/2016 | Hong | H01Q 15/0086 |
| 2016/0276734 | A1 | 9/2016 | Jin et al. | |
| 2019/0288377 | A1 * | 9/2019 | Ying | H01Q 1/38 |
| 2019/0305432 | A1 * | 10/2019 | Kim | H01Q 9/0464 |

FOREIGN PATENT DOCUMENTS

| | | | |
|---|---|---|---|
| JP | 2019-536377 | A | 12/2019 |
| KR | 10-2016-0112154 | A | 9/2016 |
| WO | 2018/095535 | A1 | 5/2018 |

* cited by examiner

*Primary Examiner* — Jason Crawford

(74) *Attorney, Agent, or Firm* — Morgan, Lewis & Bockius LLP

(57) ABSTRACT

An antenna substrate includes a body including an insulating material, a plurality of wiring layers stacked with each other in a first vertical direction in the body, and a plurality of first antenna layers stacked with each other in a third horizontal direction in the body. Each of the plurality of first antenna layers includes a plurality of conductive structures, each having a length in a second horizontal direction greater than a length in the third horizontal direction perpendicular to the second horizontal direction, that are stacked in the first vertical direction.

20 Claims, 7 Drawing Sheets

ANTENNA SUBSTRATE

CROSS-REFERENCE TO RELATED APPLICATION(S)

This application claims the benefit under 35 USC 119(a) of Korean Patent Application No. 10-2020-0064366 filed on May 28, 2020 in the Korean Intellectual Property Office, the entire disclosure of which is incorporated herein by reference for all purposes.

BACKGROUND

1. Field

The following description relates to an antenna substrate.

2. Description of Related Art

Data traffic due to mobile communications is increasing rapidly every year. Active technological development is in progress to support such leaps in data traffic in real time in a wireless network. For example, applications, such as contents of IoT (Internet of Thing)-based data, live VR/AR combined with Augmented Reality (AR), Virtual Reality (VR) and Social Networking Service (SNS), autonomous driving, and sync view (real-time video transmission from a user's point of view using an ultra-small camera), require communications to support the exchange of large amounts of data. Accordingly, millimeter wave (mmWave) communications including 5th generation (5G) communications have recently been researched, and research into the commercialization and standardization of an antenna substrate for the smooth implementation thereof is also underway.

SUMMARY

An aspect of the present disclosure is to provide an antenna substrate in which an antenna having a vertical structure may be implemented without a separate cable substrate.

According to an aspect of the present disclosure, an antenna having a vertical structure may be implemented by stacking conductive structures, having a predetermined length in anyone direction among horizontal directions, in a vertical direction, to have a desired size.

An antenna substrate according to an example may include a body including an insulating material, a plurality of wiring layers stacked with each other in a first vertical direction in the body, and a plurality of first antenna layers stacked with each other in a third horizontal direction in the body. Each of the plurality of first antenna layers may include a plurality of conductive structures, each having a length in a second horizontal direction greater than a length in the third horizontal direction perpendicular to the second horizontal direction, that are stacked in the first vertical direction.

An antenna substrate according to an example may include a plurality of insulating layers stacked in a first vertical direction, and an antenna layer including a plurality of pattern layers, stacked in the first vertical direction within the plurality of insulating layers, and a plurality of via layers penetrating through the plurality of insulating layers in the first vertical direction and connecting the plurality of pattern layers to each other. A conductive via of each of the plurality of via layers has a bar shape having a length in a second horizontal direction that may be greater than a length thereof in a third horizontal direction perpendicular to the second horizontal direction.

In accordance with a further aspect of the disclosure, an antenna substrate includes a body including a plurality of insulating layers stacked in a first vertical direction, and a patch antenna including three or more first antenna layers stacked with each other in a third horizontal direction in the body. Each of the three or more first antenna layers may extend across two or more of the plurality of insulating layers, and may have a planar area extending in the first and second directions larger than planar areas thereof extending in the second and third directions and in the first and third directions.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
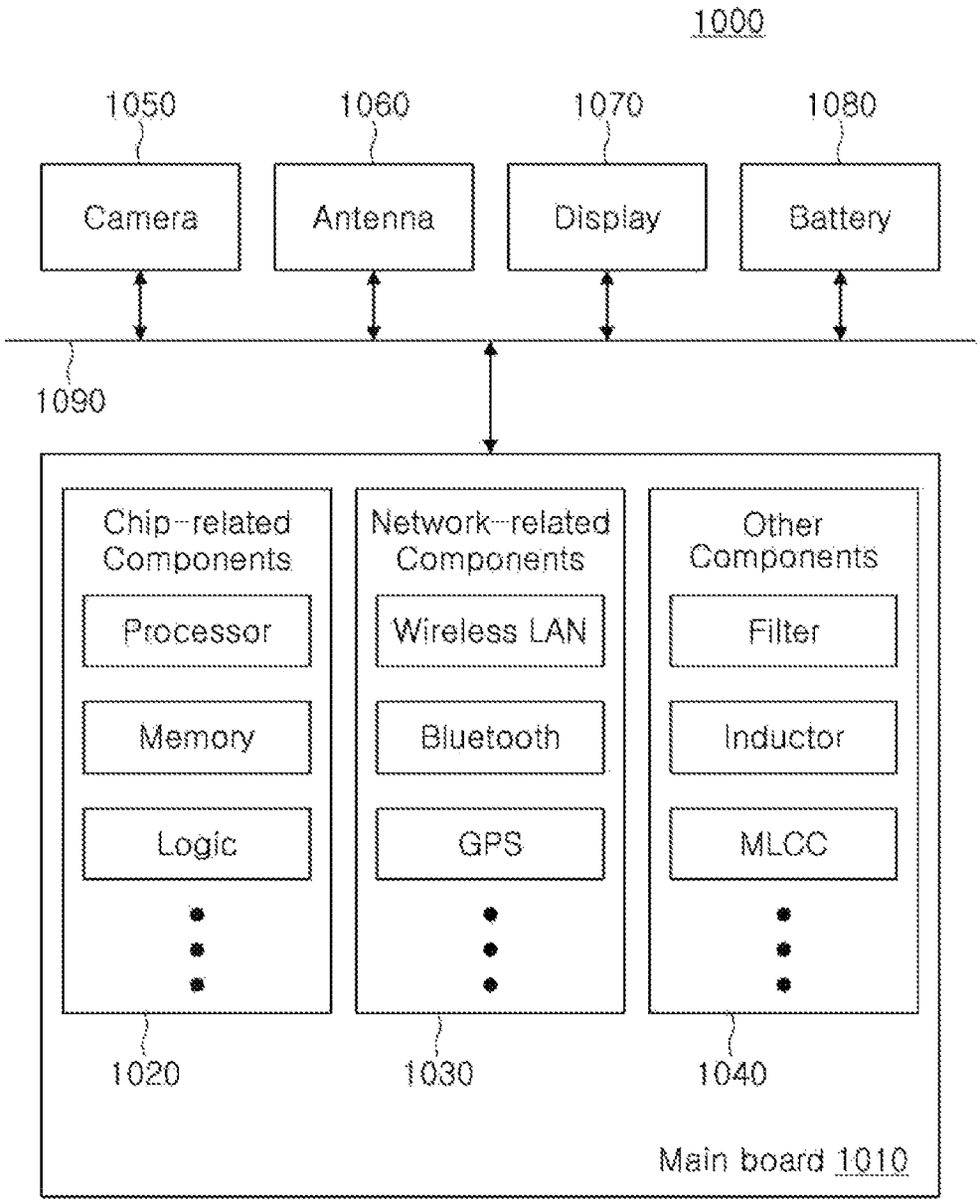
FIG. 1 is a block diagram schematically illustrating an example of an electronic device system.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that would be well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will fully convey the scope of the disclosure to one of ordinary skill in the art.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's positional relationship relative to another element in the orientation illustrated in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to differences in manufacturing techniques and/or tolerances, variations of the shapes illustrated in the drawings may occur. Thus, the examples described herein are not limited to the specific shapes illustrated in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

The drawings may not be to scale, and the relative sizes, proportions, and depiction of elements in the drawings may be exaggerated for clarity, illustration, and convenience.

FIG. 1 is a schematic block diagram illustrating an example of an electronic device system.

Referring to FIG. 1, an electronic device 1000 may accommodate a mainboard 1010 therein. The main board 1010 may include chip related components 1020, network related components 1030, other components 1040, and the like, physically or electrically connected thereto. These components may be connected to other electronic components to be described below to form various signal lines 1090.

The chip related components 1020 may include a memory chip such as a volatile memory (for example, a dynamic random access memory (DRAM)), a non-volatile memory (for example, a read only memory (ROM)), a flash memory, or the like; an application processor chip such as a central processor (for example, a central processing unit (CPU)), a graphics processor (for example, a graphics processing unit (GPU)), a digital signal processor, a cryptographic processor, a microprocessor, a microcontroller, or the like; and a logic chip such as an analog-to-digital converter (ADC), an application-specific integrated circuit (ASIC), or the like. However, the chip related components 1020 are not limited thereto, but may also include other types of chip related components. In addition, the electronic components 1020 may be combined with each other. The chip related component 1020 may be in the form of a package including the above-described chip or electronic component.

The network related components 1030 may include components implementing or compatible with protocols such as wireless fidelity (Wi-Fi) (Institute of Electrical And Electronics Engineers (IEEE) 802.11 family, or the like), worldwide interoperability for microwave access (WiMAX) (IEEE 802.16 family, or the like), IEEE 802.20, long term evolution (LTE), evolution data only (Ev-DO), high speed packet access+(HSPA+), high speed downlink packet access+(HSDPA+), high speed uplink packet access+ (HSUPA+), enhanced data GSM environment (EDGE), global system for mobile communications (GSM), global positioning system (GPS), general packet radio service (GPRS), code division multiple access (CDMA), time division multiple access (TDMA), digital enhanced cordless telecommunications (DECT), Bluetooth, 3G, 4G, and 5G protocols, and any other wireless and wired protocols, designated after the abovementioned protocols. However, the network related components 1030 are not limited thereto, but may also include components implementing or compatible with a variety of other wireless or wired standards or protocols. In addition, the network related components 1030 may be combined with each other, together with the chip related electronic components 1020 described above.

Other components 1040 may include a high frequency inductor, a ferrite inductor, a power inductor, ferrite beads, a low temperature co-fired ceramic (LTCC), an electromagnetic interference (EMI) filter, a multilayer ceramic capacitor (MLCC), or the like. However, other components 1040 are not limited thereto, and may also include passive components used for various other purposes, or the like. In addition, other components 1040 may also be combined with the chip-related electronic component 1020 and/or the network-related electronic component 1030.

Depending on a type of the electronic device 1000, the electronic device 1000 may include other electronic components that may or may not be physically or electrically connected to the mainboard 1010. These other components may include, for example, a camera module 1050, an antenna module 1060, a display device 1070, a battery 1080 and the like, but are not limited thereto. For example, these other components may also include an audio codec, a video codec, a power amplifier, a compass, an accelerometer, a gyroscope, a speaker, a mass storage unit (for example, a hard disk drive), a compact disk (CD) drive, a digital versatile disk (DVD) drive, or the like. In addition, other electronic components used for various uses depending on a type of electronic device 1000, or the like may be used.

The electronic device 1000 may be a smartphone, a personal digital assistant (PDA), a digital video camera, a digital still camera, a network system, a computer, a monitor, a tablet PC, a laptop PC, a netbook PC, a television, a video game machine, a smartwatch, an automotive component, or the like. However, the electronic device 1000 is not limited thereto, but may be any other electronic device processing data.

Figure 2:
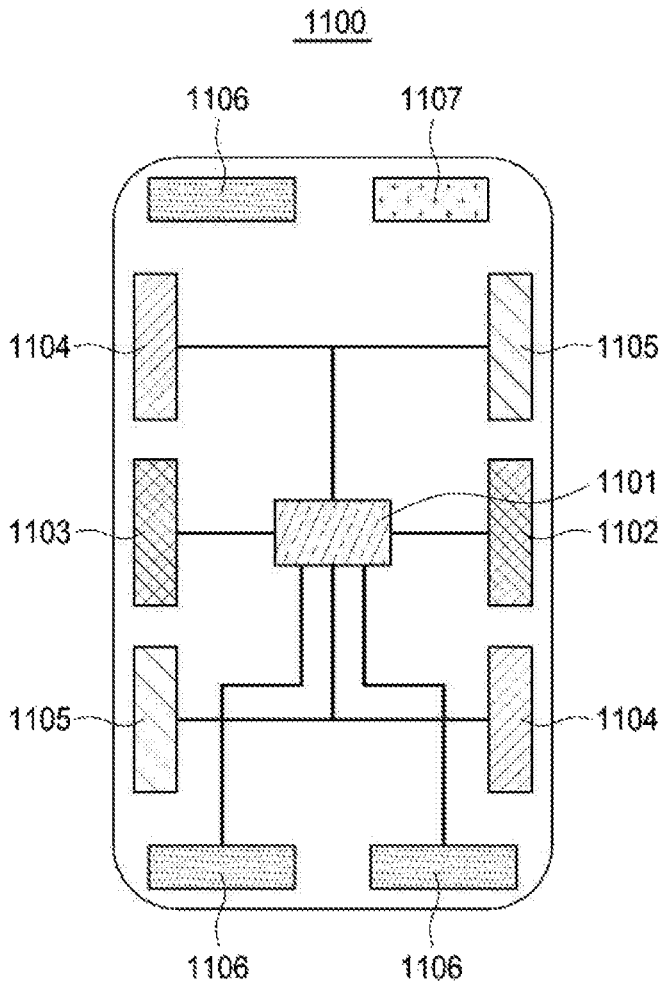
FIG. 2 is a plan view schematically illustrating an example of an electronic device.

FIG. 2 is a plan view illustrating an example of an electronic device.

Referring to FIG. 2, an electronic device may be, for example, a smartphone 1100. Inside the smartphone 1100, a modem 1101, and various types of antenna modules 1102, 1103, 1104, 1105 and 1106 connected to the modem 1101 through a Rigid Printed Circuit Board, a Flexible Printed Circuit Board, and/or a Rigid Flexible Printed Circuit Board, may be disposed. Optionally, the Wi-Fi module 1107 may also be disposed. The antenna modules 1102, 1103, 1104, 1105 and 1106 may be antenna modules 1102, 1103, 1104 and 1105 of various frequency bands for 5G mobile communication, for example, an antenna module 1102 for a 3.5 GHz band frequency, an antenna module 1103 for a 5 GHz band frequency, an antenna module 1104 for a 28 GHz band frequency, an antenna module 1105 for a 39 GHz band frequency, and the like, and may include other 4G antenna module 1106, but are not limited thereto. On the other hand, the electronic device is not necessarily limited to the smartphone 1100, of course, and may also be other electronic devices as described above.

Figure 3:
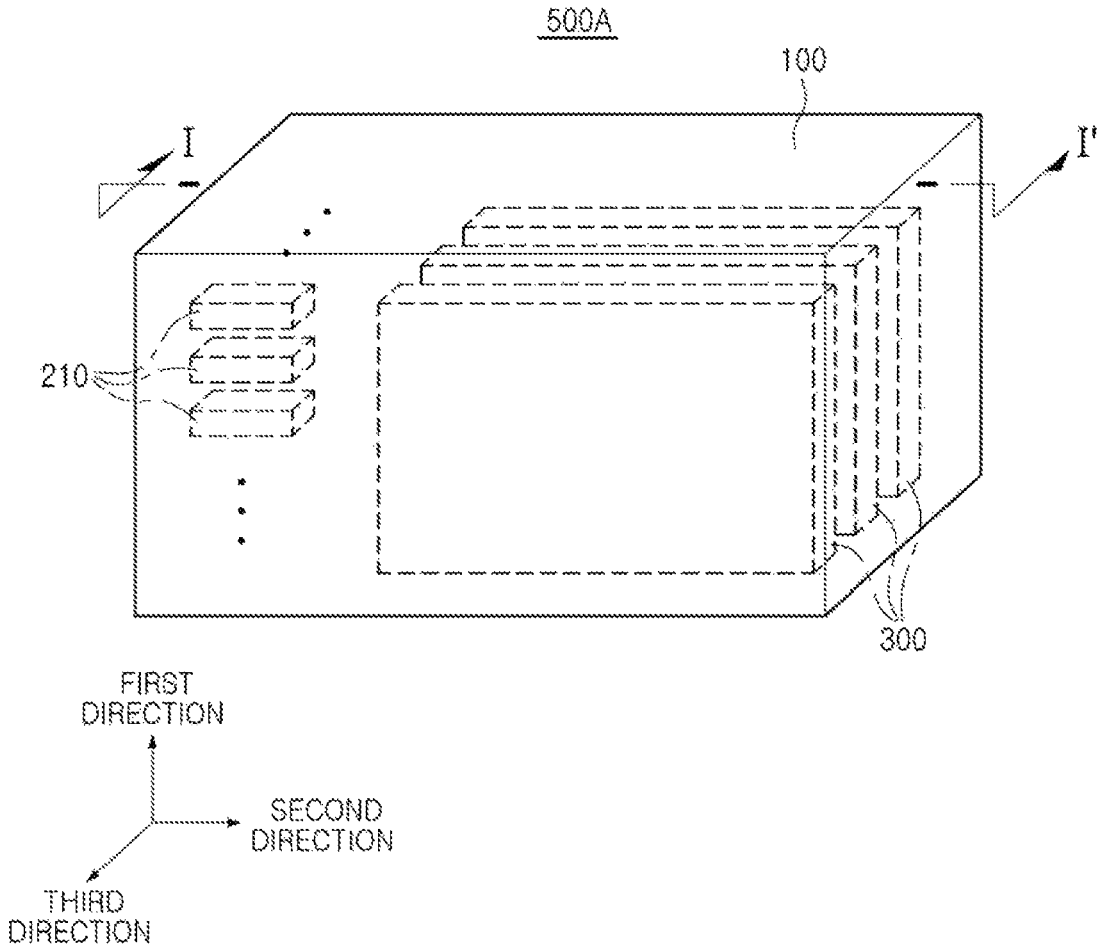
FIG. 3 is a perspective view schematically illustrating an example of an antenna substrate.

FIG. 3 is a perspective view schematically illustrating an example of an antenna substrate.

Figure 4:
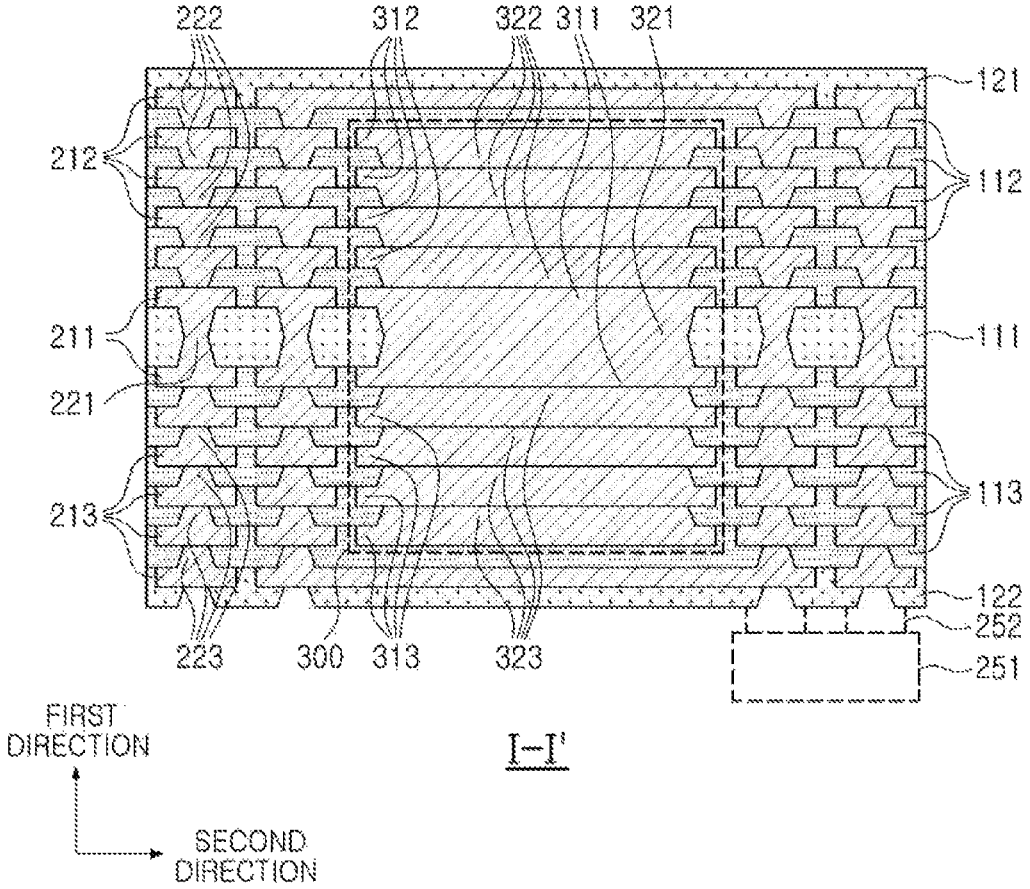
FIG. 4 is a schematic cross-sectional view taken along line I-I' of the antenna substrate of FIG. 3.

FIG. 4 is a schematic cross-sectional view taken along line I-I' of the antenna substrate of FIG. 3.

Figure 5:
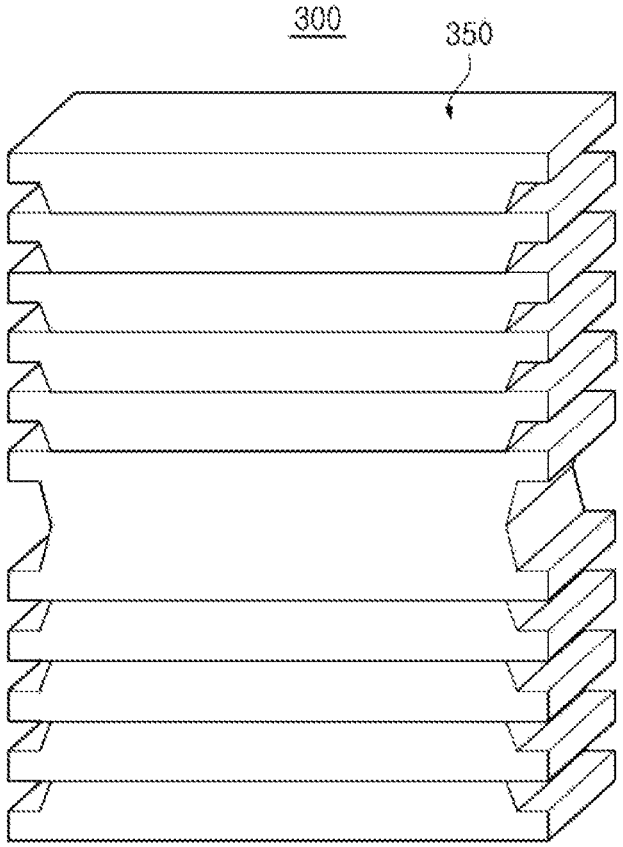
FIG. 5 is a perspective view schematically illustrating an example of an antenna layer of FIG. 4.
Figure 5:
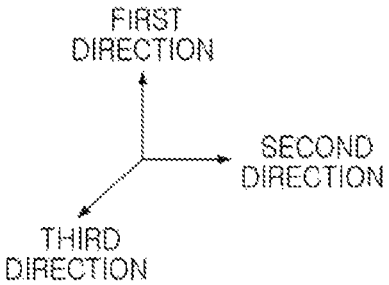

FIG. 5 is a perspective view schematically illustrating an example of an antenna layer of FIG. 4.

Referring to the drawings, an antenna substrate 500A according to an example includes a body 100 including an insulating material, a plurality of wiring layers 210 stacked in the body 100 in a first direction (a vertical direction based on the drawing), and a plurality of antenna layers 300 stacked in the body 100 in a direction different from the first direction (either a second direction or a third direction corresponding to a horizontal direction based on the drawing). In this case, each of the antenna layers 300 may have a structure oriented in the first direction (the vertical based on the drawing), for example by having a main surface (e.g., largest surface) of each antenna layer 300 extending in at least the first direction (e.g., extending in the first and second directions, as shown in FIG. 3).

For example, each antenna layer 300 may have a shape in which a plurality of conductive structures 350, each having a length in the second direction greater than a length in the third direction, are stacked in the first direction so as to form the antenna layer 300 having a main surface (e.g., largest surface) extending in the first and second directions. For instance, each conductive structure 350 may be formed of one or more pattern layer(s) (e.g., 311, 312, or 313) and a via layer (e.g., 321, 322, or 323), and the stack of such conductive structures 350 may provide the antenna layer (300) having the main surface (e.g., largest surface) extending in the first and second directions. In particular, each of the pattern layers and via layers of the conductive structures 350 have lengths in the second direction that are greater than their lengths in the third direction, and the stack of conductive structures 350 has a total length in the first direction that is greater than its length in the third direction, such that the main surface (e.g., largest surface) extends in the first and second directions.

On the other hand, in the case of an antenna substrate provided for a 5G antenna module, sensitivity of a 5G signal is significantly affected depending on the direction of the antenna due to strong linearity of 5G when the antenna substrate is mounted on the set (e.g., mounted in the handset, smartphone, or communication device). To cope with this, disposing three or more antenna modules including a 5G antenna substrate in different respective directions may be considered. In this case, at least one antenna module may be vertically disposed in the set, and to this end, it may be considered that the antenna module is connected to the set using a separate flexible printed circuit (FPC) cable board. However, in this case, loss of signal characteristics may occur due to connection through a cable, and there is a cost problem.

On the other hand, in the case of an antenna substrate 500A according to an example, the antenna substrate 500A may have a structure in which antenna layers 300 disposed in the antenna substrate 500A are respectively oriented in the first direction as described above, even without use of any FPC. Therefore, when the antenna substrate 500A is applied to a 5G antenna module and disposed in a set, an antenna having a vertical structure may be implemented without a separate FPC cable substrate. In this case, efficiency may be obtained through direct mounting of the vertical structure. In addition, since the antenna of the vertical structure is implemented using the stack of the conductive structures 350, the vertical structure of the antenna layer 300 may be easily implemented in or manufactured using the same fabrication process as the substrate, and the antenna layer 300 of a relatively wide plane may be more easily implemented.

Hereinafter, each component of the antenna substrate 500A according to an example will be described in more detail with reference to the drawings.

The body 100 includes a plurality of insulating layers 111, 112, and 113 stacked in the first direction. If desired, the body 100 may further include a plurality of passivation layers 121 and 122 disposed on an uppermost insulating layer 112 and a lowermost insulating layer 113 in the first direction among the plurality of insulating layers 111, 112 and 113, respectively. The plurality of insulating layers (111, 112 and 113) include core insulating layer 111, and plurality of first and second build-up insulating layers 112 and 113 disposed on both sides of the core insulating layer 111, based on the first direction. The core insulating layer 111 may have a thickness greater than that of each of the first and second build-up insulating layers 112 and 113. However, an embodiment of the present disclosure is not limited thereto, and for example, one of the core insulating layer 111 and a plurality of first and second build-up wiring layers 112 and 113 may be omitted, so that the antenna substrate 500A may have the form of a coreless substrate.

The plurality of insulating layers 111, 112 and 113 may each include an insulating material. As the insulating material, a thermosetting resin such as an epoxy resin, a thermoplastic resin such as polyimide, or a material including a reinforcing material, such as a woven glass fiber and/or an inorganic filler, for example, Prepreg, Ajinomoto Build-up Film (ABF), Photo Imageable Dielectric (PID), or the like, may be used.

The plurality of insulating layers 111, 112, and 113 may each include a laminate of a thermoplastic resin layer and a thermosetting resin layer. The thermoplastic resin layer may include a material that is effective for high frequency signal transmission, and the thermosetting resin layer may include a material that is advantageous for high frequency signal transmission and has excellent bonding properties. Through such a multilayer resin layer, an insulating body that is advantageous for high-frequency signal transmission and has excellent adhesion may be provided.

As the thermoplastic resin layer, liquid crystal polymer (LCP), polytetrafluoroethylene (PTFE), polyphenylene sulfide (PPS), polyphenylene ether (PPE), polyimide (PI), or the like may be used in terms of high-frequency signal transmission. A dielectric loss factor Df may be adjusted depending on the type of the resin in the thermoplastic resin layer, the type of filler contained in the resin, the content of the filler, and the like. Dielectric loss factor (Df) is a value for dielectric loss, and dielectric loss indicates loss power generated when an alternating electric field is formed in a resin layer (dielectric). The dielectric loss factor (Df) is proportional to the dielectric loss, and the smaller the dielectric loss factor (Df) is, the lower the dielectric loss is. The thermoplastic resin layer having low dielectric loss characteristics is advantageous in terms of loss reduction in high frequency signal transmission. The dielectric loss factor (Df) of the thermoplastic resin layer may be 0.003 or less, for example, 0.002 or less. In addition, a dielectric constant (Dk) of the thermoplastic resin layer may be 3.5 or less. The dielectric constant (Dk) may be measured through a vector network analyzer using a Dielectric Assessment Kit (DAK), for example, which may be applied in the descriptions below in the same manner, although alternative measurement approaches may also be used.

As the thermosetting resin layer, polyphenylene ether (PPE), modified polyimide (PI), modified epoxy, or the like may be used in terms of high frequency signal transmission. The dielectric loss factor Df may be adjusted depending on the type of the resin of the thermosetting resin layer, the type of filler contained in the resin, the content of the filler, and the like. The thermosetting resin layer having low dielectric loss characteristics is advantageous in terms of loss reduction in high frequency signal transmission. The dielectric loss factor (Df) of the thermosetting resin layer may be 0.003 or less, for example, 0.002 or less. In addition, the dielectric constant (Dk) of the thermosetting resin layer may be 3.5 or less.

The thickness of the thermoplastic resin layer may be greater than that of the thermosetting resin layer. In terms of high frequency signal transmission, it may be more desirable to have this thickness relationship. An interface between the thermoplastic resin layer and the thermosetting resin layer adjacent to each other in the vertical direction may include a roughness surface. The roughness surface refers to a surface having unevenness by being roughened. By such roughness surface, the thermoplastic resin layer and the thermosetting resin layer adjacent to each other in the vertical direction may secure improved adhesion to each other.

The plurality of passivation layers 121 and 122 may protect the internal configuration of the antenna substrate 500A from external physical and chemical damage. The plurality of passivation layers 121 and 122 may each include a thermosetting resin. For example, the passivation layers 121 and 122 may be ABF. However, the present disclosure is not limited thereto, and the passivation layers 121 and 122 may be Solder Resist (SR) layers. Also, optionally, the passivation layers may include Photo Image-able Dielectric (PID). The lower passivation layer 122 may have a plurality of openings.

A plurality of wiring layers 210 (211, 212 and 213) are stacked in the first direction in the plurality of insulating layers 111, 112 and 113. The plurality of wiring layers 211, 212 and 213 may include a plurality of core wiring layers 211 and a plurality of first and second build-up wiring layers 212 and 213 disposed on both sides of the plurality of core wiring layers 211, based on the first direction. Based on the first direction, the plurality of core wiring layers 211 are disposed on both opposing sides of the core insulating layer 111. The plurality of first and second build-up wiring layers 212 and 213 are disposed on the plurality of first and second build-up insulating layers 112 and 113, respectively, based on the first direction. On the other hand, when one of the core insulating layer 111 and the plurality of first and second build-up insulating layers 112 and 113 is omitted and thus the antenna substrate 500A has the form of a coreless substrate, the plurality of core wiring layers 211, and one of the plurality of first and second build-up wiring layers 212 and 213 may be omitted.

Each of the plurality of wiring layers 211, 212 and 213 may include a metal material. As the metallic material, copper (Cu), aluminum (Al), silver (Ag), tin (Sn), gold (Au), nickel (Ni), lead (Pb), titanium (Ti), or alloys thereof may be used. The plurality of wiring layers 211, 212 and 213 may be formed by Additive Process (AP), Semi AP (SAP), Modified SAP (MSAP), Tenting (TT), or the like, and as a result, may include a seed layer that is an electroless plating layer, and an electrolytic plating layer formed based on the seed layer. The plurality of wiring layers 211, 212 and 213 may perform various functions according to the design of the corresponding layer. For example, the plurality of wiring layers 211, 212 and 213 may include a feed pattern. In addition, the plurality of wiring layers 211, 212 and 213 may include a ground pattern, a power pattern, a signal pattern, and the like. Each of these patterns may include a line pattern, a plane pattern, and/or a pad pattern. At least one of the plurality of wiring layers 211, 212 and 213 may be electrically connected to at least one of the plurality of pattern layers 311, 312 and 313, to be described later, of at least one of the plurality of antenna layers 300.

A plurality of wiring via layers 221, 222 and 223 penetrate through the plurality of insulating layers 111, 112 and 113 in the first direction, to connect the plurality of wiring layers 211, 212 and 213 to each other. The plurality of wiring via layers (221, 222 and 223) include core wiring via layer 221, and plurality of first and second build-up wiring via layers 222 and 223 disposed on both sides of the core wiring via layer 221, based on the first direction. The core wiring via layer 221 penetrates through the core insulating layer 111 in the first direction, and connects the core wiring layers 211 disposed on both sides of the core insulating layer 111 to each other. The plurality of first and second build-up wiring via layers 222 and 223 penetrate through the plurality of first and second build-up insulating layers 112 and 113, respectively, based on the first direction, and connect the plurality of first and second build-up wiring layers 212 and 213 and the plurality of core wiring layers 211 to each other. On the other hand, in the case in which one of the core insulating layer 111 and the plurality of first and second build-up insulating layers 112 and 113 is omitted, such that the antenna substrate 500A has the form of a coreless substrate, the core wiring via layer 221, and one of the plurality of first and second build-up wiring via layers 222 and 223 may be omitted.

The plurality of wiring via layers 221, 222 and 223 may each include a metal material. As the metallic material, copper (Cu), aluminum (Al), silver (Ag), tin (Sn), gold (Au), nickel (Ni), lead (Pb), titanium (Ti), or alloys thereof may be used. The plurality of wiring via layers 221, 222 and 223 may also be formed by a plating process such as AP, SAP, MSAP, TT or the like, and as a result, may each include a seed layer that is an electroless plating layer, and an electrolytic plating layer formed based on the seed layer. The plurality of wiring via layers 221, 222 and 223 may perform various functions according to designs. For example, the plurality of wiring via layers 221, 222 and 223 may include a feed via for a connection of a feed pattern, a signal via for a connection of a signal, a ground via for a connection of a ground, a power via for a connection of power, and the like. These vias may be respectively, completely filled with a metal material, or may be formed as a metal material formed along the wall surface of the via hole. In addition, the plurality of wiring via layers 221, 222 and 223 may have various shapes such as a taper shape, an hourglass shape and the like.

The antenna layer 300 respectively includes a plurality of pattern layers 311, 312 and 313 stacked in the first direction within the plurality of insulating layers 111, 112 and 113, and a plurality of via layers 321, 322 and 323 penetrating through the plurality of insulating layers 111, 112 and 113 in the first direction to connect the plurality of pattern layers 311, 312 and 313 to each other. The plurality of via layers 321, 322 and 323 are disposed in the form of stacked vias with the plurality of pattern layers 311, 312 and 313 interposed therebetween. For example, the plurality of via layers 321, 322 and 323 can be disposed so as to be stacked and overlap with each other in the first direction with the plurality of pattern layers 311, 312 and 313 interposed therebetween. For instance, three or more conductive vias of the plurality of via layers 321, 322 and 323 can be in direct alignment and overlap with each other in the first direction.

The conductive structure 350 may have a shape in which the respective pattern layers 311, 312 and 313 adjacent in the first direction and the via layers 321, 322, 323 are integrally connected to each other. For example, in a core region, two core pattern layers 311 and one core via layer 321 therebetween may be integrally connected to each other to form the conductive structure 350. Further, in a build-up region, one first build-up pattern layer 312 and one first build-up via layer 322 adjacent thereto, or one second build-up pattern layer 313 and one second build-up via layer 323 adjacent thereto, may be integrally connected to each other to form the conductive structure 350. Therefore, each of the antenna layers 300 may have a vertical structure oriented in the first direction, and thus, the planar area of the antenna layer 300 when viewed from the third direction may be larger than the planar area thereof when viewed from the first direction. Additionally, the planar area of the antenna layer 300 when viewed from the third direction may be larger than the planar area thereof when viewed from the first and second directions. At least portions of the plurality of antenna layers 300 may overlap each other in the third direction, thereby constructing a patch antenna.

The plurality of pattern layers (311, 312 and 313) include a plurality of core pattern layers 311 and a plurality of first and second build-up pattern layers 312 and 313 disposed on both sides of the plurality of core pattern layers 311 based on the first direction. The plurality of core pattern layers 311 are disposed on both sides of the core insulating layer 111 based on the first direction. The plurality of first and second build-up pattern layers 312 and 313 are disposed on the plurality of first and second build-up insulating layers 112 and 113, respectively, based on the first direction. On the other hand, in the case in which one of the core insulating layer 111 and the plurality of first and second build-up insulating layers 112 and 113 is omitted, such that the antenna substrate 500A has the form of a coreless substrate as described above, similarly, the plurality of core pattern layers 311 and one of the plurality of first and second build-up pattern layers 312 and 313 may be omitted.

Each of the plurality of pattern layers 311, 312 and 313 may include a metal material. As the metallic material, copper (Cu), aluminum (Al), silver (Ag), tin (Sn), gold (Au), nickel (Ni), lead (Pb), titanium (Ti), or alloys thereof may be used. The plurality of pattern layers 311, 312 and 313 may be formed using AP, SAP, MSAP, TT, or the like, and as a result, may each include a seed layer, an electroless plating layer, and an electrolytic plating layer formed based on the seed layer. The conductor pattern of each of the plurality of pattern layers 311, 312 and 313 may have a bar shape of which the length in the second direction is greater than the length thereof in the third direction.

The plurality of via layers (321, 322 and 323) may include core via layer 321, and plurality of first and second build-up via layers 322 and 323 disposed on both sides of the core via layer 321, based on the first direction. The core via layer 321 penetrates through the core insulating layer 111 based on the first direction and connects the plurality of core pattern layers 311 disposed on both sides of the core insulating layer 111 to each other. The plurality of first and second build-up via layers 322 and 323 penetrate through the plurality of first and second build-up insulating layers 112 and 113, respectively, based on the first direction, and connect the plurality of first and second build-up pattern layers 312 and 313 and the plurality of core pattern layers 311 to each other. On the other hand, in the case in which one of the core insulating layer 111 and the plurality of first and second build-up insulating layers 112 and 113 is omitted such that the antenna substrate 500A has the form of a coreless substrate as described above, the core via layer 321 and one of the plurality of first and second build-up via layers 322 and 323 may be omitted.

The plurality of via layers 321, 322 and 323 may each include a metal material. As the metallic material, copper (Cu), aluminum (Al), silver (Ag), tin (Sn), gold (Au), nickel (Ni), lead (Pb), titanium (Ti), or alloys thereof may be used. The plurality of via layers 321, 322 and 323 may also be formed by a plating process such as AP, SAP, MSAP, TT, or the like, and as a result, each may include a seed layer as an electroless plating layer, and an electrolytic plating layer formed based on the seed layer. The conductive via of each of the plurality of via layers 321, 322 and 323 may have a bar shape of which the length in the second direction is greater than the length thereof in the third direction. In this case, the side surface of each conductive via may have a tapered shape based on the first direction or an hourglass shape.

Optionally, an electronic component 251 may be disposed, in the form of surface mount, on the body 100, for example, on the lower passivation layer 122 based on the first direction. In this case, the antenna substrate 500A may function as an antenna module. The electronic component 251 may be electrically connected to at least a portion of the plurality of wiring layers 211, 212 and 213 through a connecting metal 252 formed in the opening of the lower passivation layer 122. In this case, the electronic component 251 may also be electrically connected to at least one of the plurality of antenna layers 300.

The electronic component 251 may include at least one of a power management integrated circuit (PMIC), a radio frequency integrated circuit (RFIC), and a passive component. The passive component may be a chip-type passive component, for example, a chip-type capacitor or a chip-type inductor, but is not limited thereto. The connecting metal 252 may be composed of a low melting point metal having a melting point lower than that of copper (Cu), and may for example be formed of tin (Sn) or an alloy containing tin (Sn). For example, the connecting metal 252 may be formed of solder, but this formation is only an example, and the material thereof is not limited thereto.

Figure 6:
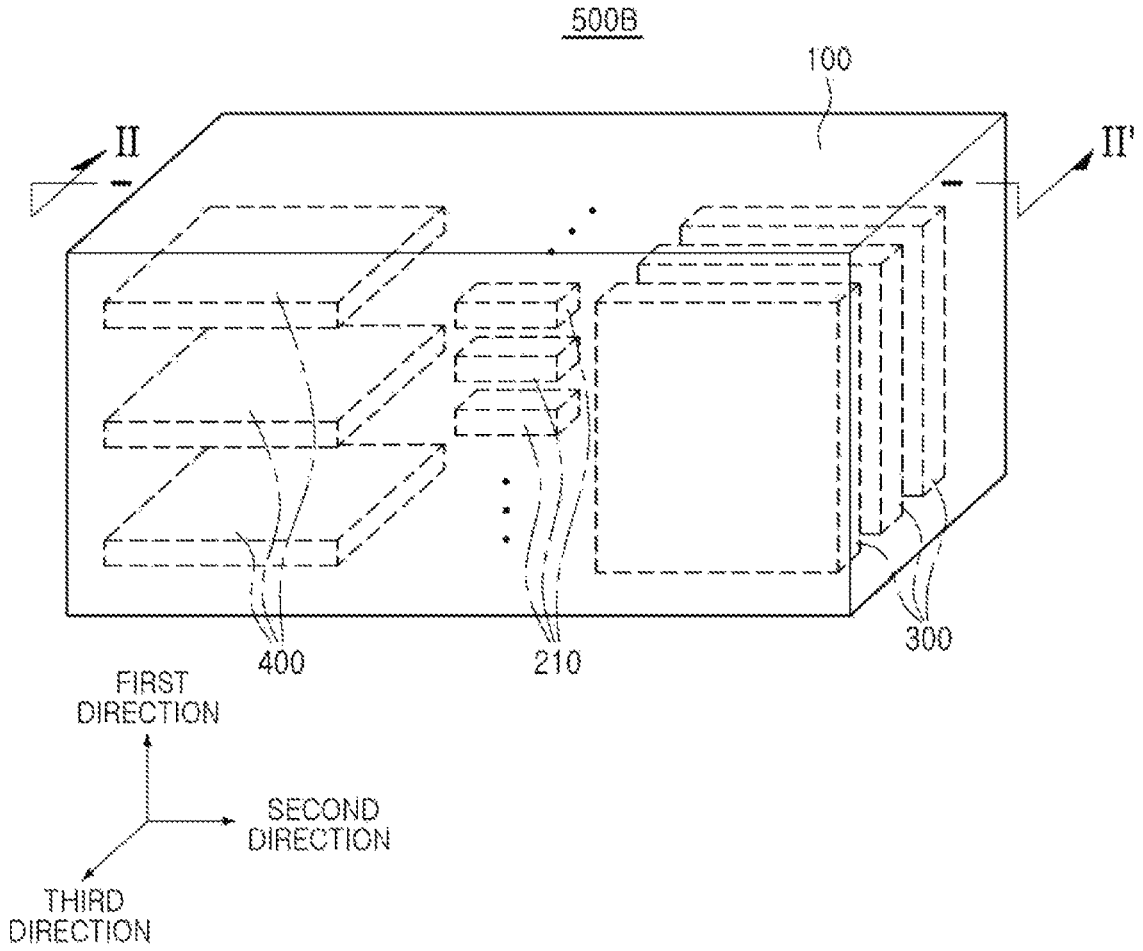
FIG. 6 is a perspective view schematically illustrating another example of an antenna substrate.

FIG. 6 is a perspective view schematically illustrating another example of an antenna substrate.

Figure 7:
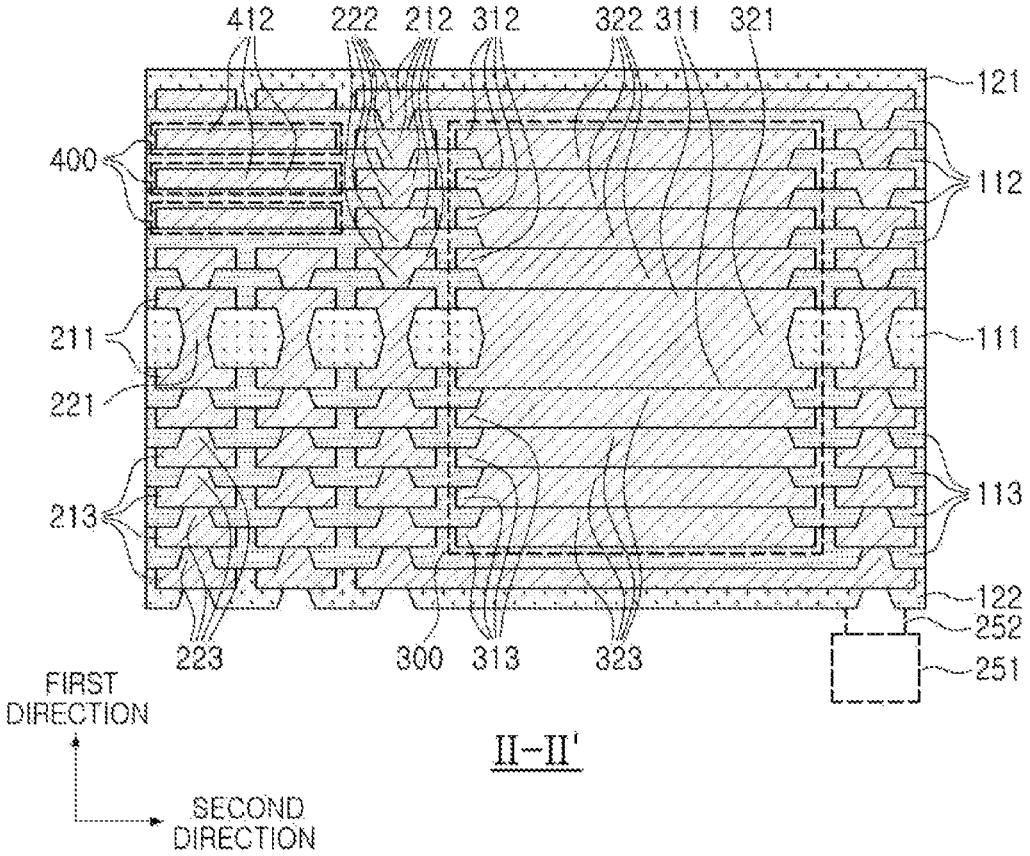
FIG. 7 is a schematic cross-sectional view taken along line II-II' of the antenna substrate of FIG. 6.

FIG. 7 is a schematic cross-sectional view taken along line II-II' of the antenna substrate of FIG. 6.

Referring to the drawings, an antenna substrate 500B according to another example further includes a plurality of second antenna layers 400 stacked in the body in the first direction, as well as the plurality of first antenna layers 300 stacked in the body in the third direction. Each of the first antenna layers 300 has a vertical structure oriented in the first direction (e.g., in the first and second directions), while the second antenna layers 400 each have a horizontal structure oriented in the second direction and the third direction. Each of the first antenna layers 300 may have a vertical structure oriented in the first direction (e.g., a main surface, corresponding to a largest surface of each first antenna layer 300, extends in the first and second directions), and the planar area of the first antenna layer when viewed from the third direction is larger than the planar area thereof when viewed from the first direction or the second direction. In contrast, the second antenna layers 400 may each have a horizontal structure oriented in the second direction and the third direction (e.g., a main surface, corresponding to a largest surface of each second antenna layer 400, extends in the second and third directions), and the planar area of the second antenna layer 400 when viewed from the first direction is larger than the planar area thereof when viewed from the second direction or the third direction. The plurality of first antenna layers 300 may form a patch antenna by at least partially overlapping each other in the third direction, and the plurality of second antenna layers 400 may constitute a patch antenna by at least partially overlapping each other in the first direction. In this case, the patch antenna of the vertical structure and the patch antenna of the horizontal structure may be simultaneously implemented in one antenna substrate 500B, and as a result, the number of 5G antenna modules may be reduced.

Each of the second antenna layers 400 may include a pattern layer 412. Each of the pattern layers 412 may include a metal material. As the metallic material, copper (Cu), aluminum (Al), silver (Ag), tin (Sn), gold (Au), nickel (Ni), lead (Pb), titanium (Ti), or alloys thereof may be used. The pattern layer 412 may be formed using AP, SAP, MSAP, TT, or the like, and as a result, may include a seed layer that is an electroless plating layer and an electrolytic plating layer formed based on the seed layer. The conductor pattern of each pattern layer 412 may have a plane shape. For example, the conductor pattern of each pattern layer 412 may extend in a plane shape along the second and third directions, and may have a thickness in the first direction smaller than dimensions thereof in both of the second and third directions. Moreover, the multiple pattern layers 412 may overlap with each other in the first direction and, in the example shown, may be free of any conductive via therebetween located within the region of overlap. Additionally, the second antenna layers 400 may include three or more pattern layers 412 overlapping each other in the first direction and having an area of overlap that is wider in each of the second and third directions than a total thickness thereof in the first direction. At least one of the plurality of wiring layers 211, 212 and 213 may be electrically connected to at least one pattern layer 412 of the plurality of second antenna layers 400. When a plurality of electronic components 251 are disposed on the body 100, the plurality of electronic components 251 may be respectively, electrically connected to at least one of the plurality of first antenna layers 300, and at least one of the plurality of second antenna layers 400. Other contents are substantially the same as those described above, and detailed description is omitted.

As set forth above, according to an example, an antenna substrate may be provided in which an antenna has a vertical structure without a separate cable substrate.

The meaning of being connected in the present disclosure encompasses not only a direct connection, but also includes an indirect connection through an adhesive or the like. In addition, the term "electrically connected" means a concept including both a physical connection and non-connection. Further, the first and second expressions are used to distinguish one component from another component and do not limit the order and/or importance of components and the like. In some cases, without departing from the scope of the rights, a first component may be referred to as a second component, and similarly, a second component may also be referred to as a first component.

The expression, an example, used in the present disclosure does not mean the same embodiment, but is provided for emphasizing and explaining different unique features. However, the above-mentioned examples do not exclude implementations that include combinations of the features described in different examples. For example, although a feature described in one specific example is not described in another example, it may be understood that the feature can nonetheless can be implemented in the other example, unless otherwise described or contradicted by the other example.

The terms used in the present disclosure are only used to illustrate an example and are not intended to limit the present disclosure. The singular expressions include plural expressions unless the context clearly dictates otherwise.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna substrate comprising:

a body including an insulating material;

a plurality of wiring layers stacked with each other in a first vertical direction in the body; and a plurality of first antenna layers stacked with each other in a third horizontal direction in the body, wherein each of the plurality of first antenna layers includes a plurality of conductive structures, each having a length in a second horizontal direction greater than a length in the third horizontal direction perpendicular to the second horizontal direction, are stacked in the first vertical direction.

2. The antenna substrate of claim 1, wherein each of the plurality of first antenna layers has a planar area extending in the first and second directions larger than a planar area extending in the second and third directions.

3. The antenna substrate of claim 1, wherein each of the plurality of first antenna layers has at least a portion overlapping each other first antenna layer of the plurality of first antenna layers in the third horizontal direction.

4. The antenna substrate of claim 3, wherein the plurality of first antenna layers constitute a patch antenna.

5. The antenna substrate of claim 1, further comprising a plurality of second antenna layers stacked with each other in the first vertical direction in the body.

6. The antenna substrate of claim 5, wherein each of the plurality of second antenna layers has a planar area extending in the second and third directions larger than each of a planar area extending in the first and second directions and a planar area extending in the first and third directions.

7. The antenna substrate of claim 1, further comprising an electronic component disposed on a surface of the body and electrically connected to at least a portion of the plurality of wiring layers, wherein the electronic component includes at least one of a power management integrated circuit (PMIC), a radio frequency integrated circuit (RFIC), and a passive component.

8. An antenna substrate comprising:

a plurality of insulating layers stacked in a first vertical direction; and an antenna layer including a plurality of pattern layers, stacked in the first vertical direction within the plurality of insulating layers, and a plurality of via layers penetrating through the plurality of insulating layers in the first vertical direction and connecting the plurality of pattern layers to each other, wherein a conductive via of each of the plurality of via layers has a bar shape having a length in a second horizontal direction that is greater than a length thereof in a third horizontal direction perpendicular to the second horizontal direction.

9. The antenna substrate of claim 8, wherein in the first vertical direction, the conductive vias of the plurality of via layers are disposed in a form of stacked vias with the plurality of pattern layers interposed therebetween.

10. The antenna substrate of claim 8, wherein a conductor pattern of each of the plurality of pattern layers has a bar shape having a length in the second horizontal direction that is greater than a length thereof in the third horizontal direction.

11. The antenna substrate of claim 10, wherein the antenna substrate includes a plurality of antenna layers including the antenna layer, and the antenna layers of the plurality of antenna layers are stacked in the third horizontal direction.

12. The antenna substrate of claim 8, further comprising:

a plurality of wiring layers stacked in the first vertical direction within the plurality of insulating layers; and a plurality of wiring via layers penetrating through the plurality of insulating layers in the first vertical direction to connect the plurality of wiring layers to each other.

13. The antenna substrate of claim 12, wherein at least one of the plurality of wiring layers is electrically connected to at least one of the plurality of pattern layers.

14. The antenna substrate of claim 12, further comprising a plurality of passivation layers respectively disposed on an uppermost insulating layer and a lowermost insulating layer among the plurality of insulating layers in the first vertical direction.

15. An antenna substrate comprising:

a body including a plurality of insulating layers stacked in a first vertical direction; and a patch antenna including three or more first antenna layers stacked with each other in a third horizontal direction in the body, wherein each of the three or more first antenna layers extends across two or more of the plurality of insulating layers, and has a planar area extending in the first and second directions larger than planar areas thereof extending in the second and third directions and in the first and third directions.

16. The antenna substrate of claim 15, wherein each first antenna layer of the three or more first antenna layers includes a plurality of pattern layers overlapping each other in the first vertical direction, and a plurality of via layers each including a conductive via having a bar shape having a length in the second horizontal direction that is greater than a length thereof in the third horizontal direction.

17. The antenna substrate of claim 15, wherein the conductive vias of the plurality of via layers of each respective first antenna layer overlap with each other and with the plurality of pattern layers of the respective first antenna layer in the first vertical direction.

18. The antenna substrate of claim 15, further comprising:

a second patch antenna disposed adjacent to the patch antenna in the body and including a plurality of second antenna layers stacked with each other in the first vertical direction in the body, wherein each of the plurality of second antenna layers has a pattern layer disposed on a respective insulating layer of the plurality of insulating layers and overlapping pattern layers of other second antenna layers in the first direction.

19. The antenna substrate of claim 18, wherein each pattern layer of the second antenna layers has a planar area extending in the second and third directions larger than planar areas thereof extending in the first and second directions and in the first and third directions.

20. The antenna substrate of claim 15, wherein each first antenna layer of the three or more first antenna layers includes a plurality of conductive via extending through respective insulating layers of the plurality of insulating layers, and conductive vias of at least three different first antenna layers are aligned to overlap with each other in the third horizontal direction in the body.

* * * * *